US012673843B2

(12) United States Patent
Abrial et al.

(10) Patent No.: US 12,673,843 B2
(45) Date of Patent: Jul. 7, 2026

(54) CABLE-COILING SYSTEM

(71) Applicant: Alcatel Submarine Networks, Nozay (FR)

(72) Inventors: Francois-Xavier Abrial, Bleury (FR); Guillaume Choquel, Rinxent (FR); Michele Barezzani, Saint-Aubin (FR)

(73) Assignee: Alcatel Submarine Networks, Nozay (FR)

( * ) Notice: Subject to any disclaimer, the term of this patent is extended or adjusted under 35 U.S.C. 154(b) by 703 days.

(21) Appl. No.: 18/061,166

(22) Filed: Dec. 2, 2022

(65) Prior Publication Data

US 2023/0174339 A1 Jun. 8, 2023

(30) Foreign Application Priority Data

Dec. 6, 2021 (EP) ..... 21306713

(51) Int. Cl.
*B65H 54/80* (2006.01)

(52) U.S. Cl.
CPC ..... *B65H 54/80* (2013.01); *B65H 2553/42* (2013.01); *B65H 2553/81* (2013.01); *B65H 2701/32* (2013.01)

(58) Field of Classification Search
CPC ..... B65H 54/80; B65H 2701/32; B65H 2701/34; B65H 2553/81; B65H 54/78;
(Continued)

(56) References Cited

U.S. PATENT DOCUMENTS 4,513,922 A * 4/1985 Dufour ..... B65H 54/80 242/477
4,871,121 A * 10/1989 Kodaka ..... G02B 6/4427 385/100

(Continued)

FOREIGN PATENT DOCUMENTS

CN 203294917 U 11/2013
CN 107473025 A 12/2017

(Continued)

OTHER PUBLICATIONS

Extended European Search Report for corresponding European application No. 21306713.5; dated Jun. 7, 2022 (10 pages).

(Continued)

*Primary Examiner* — Anna M Momper
(74) *Attorney, Agent, or Firm* — Mendelsohn Dunleavy, P.C; Steve Mendelsohn

(57) ABSTRACT

An automated system for coiling a large (e.g., >1000 km) length of cable in a cable tank. In an example embodiment, the system comprises a gantry positioned above the cable tank and a swarm of robots deployed on the floor of the tank. The gantry operates to controllably move a touchdown point of the cable, which is being fed into the tank by a cable engine. Each of the robots is equipped with a rake that can be used to push or pull downed sections of the cable on the floor of the tank. An electronic controller operates to control the speed of the cable engine and movements of the gantry and individual robots to coil the cable in the tank in spirally wound, vertically stacked layers. Different embodiments of the system may be used for cable coiling at the cable factory and on the deck of a cable-laying ship.

20 Claims, 8 Drawing Sheets

(58) Field of Classification Search
CPC .. B65H 75/364; B65H 2701/36; B65H 49/16; B65H 75/425; B65H 54/04; B65H 54/76–82; B65D 85/04
See application file for complete search history.

(56) References Cited

U.S. PATENT DOCUMENTS 5,506,381 A * 4/1996 Matsushima ..... B23H 7/10 72/146
5,506,831 A * 4/1996 Iwahara ..... G11B 19/04 360/75

FOREIGN PATENT DOCUMENTS

| | | | | | |
|---|---|---|---|---|---|
| CN | 107161814 | B | | 8/2018 | |
| CN | 113307098 | A | * | 8/2021 | ..... B65H 63/036 |
| DE | 19835711 | A1 | * | 12/1999 | ..... B65H 54/80 |
| JP | 2000-184540 | A | | 6/2000 | |
| WO | 2020161482 | A1 | | 8/2020 | |

OTHER PUBLICATIONS

Araki, Eji, et al. "Cable Loading System for Submarine Cable Construction: The Submarine Cable Loading System." NTT Review 5.1 (1993): 89-92.
Hultman, Erik, et al. "Utilizing cable winding and industrial robots to facilitate the manufacturing of electric machines." Robotics and Computer-Integrated Manufacturing 29.1 (2013): 246-256.

* cited by examiner

100

200

200

200

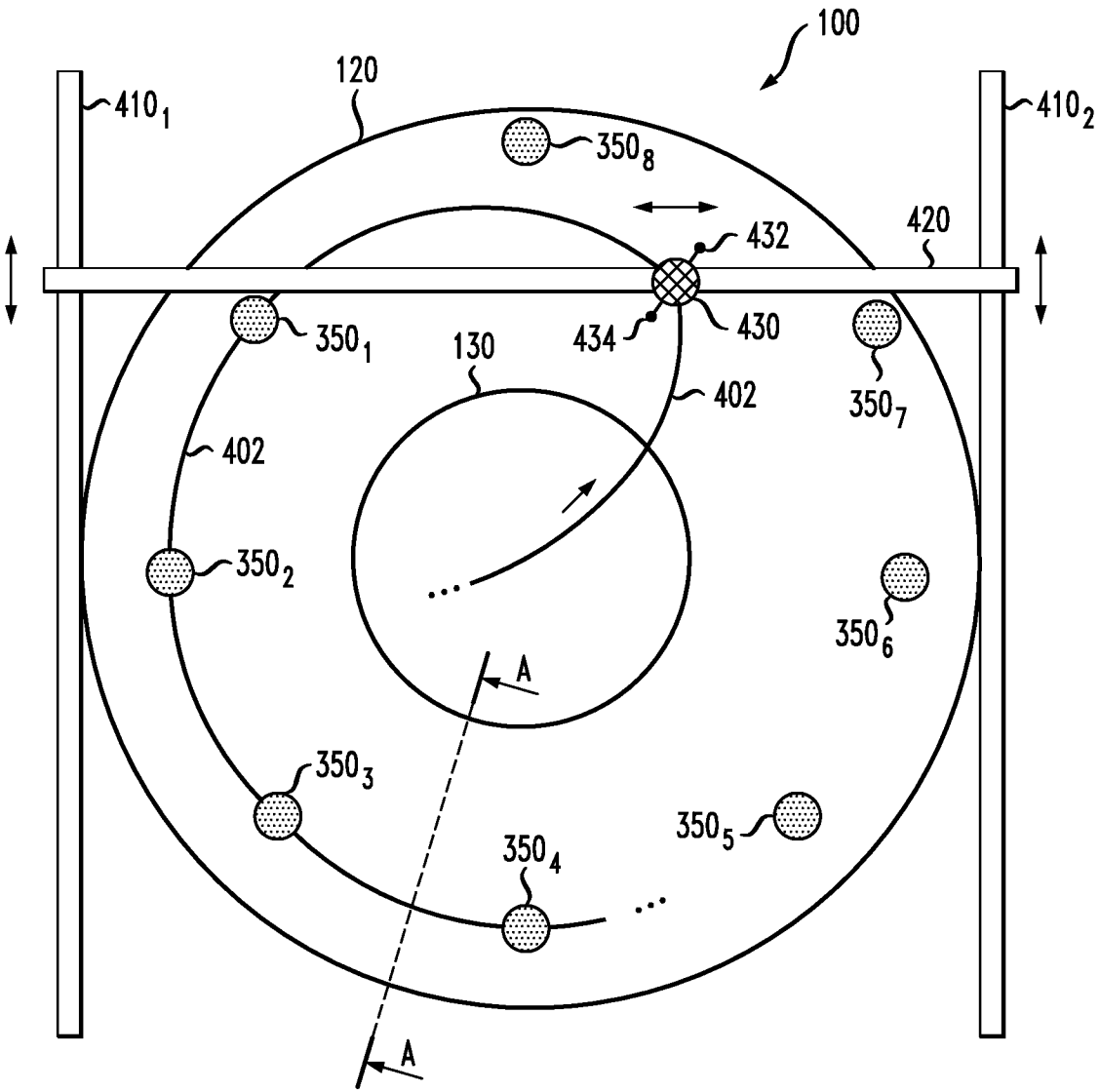
FIG. 4
400
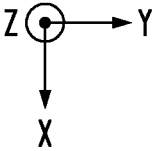

AA $t = t_1$

AA $t = t_2 > t_1$ $350_n$

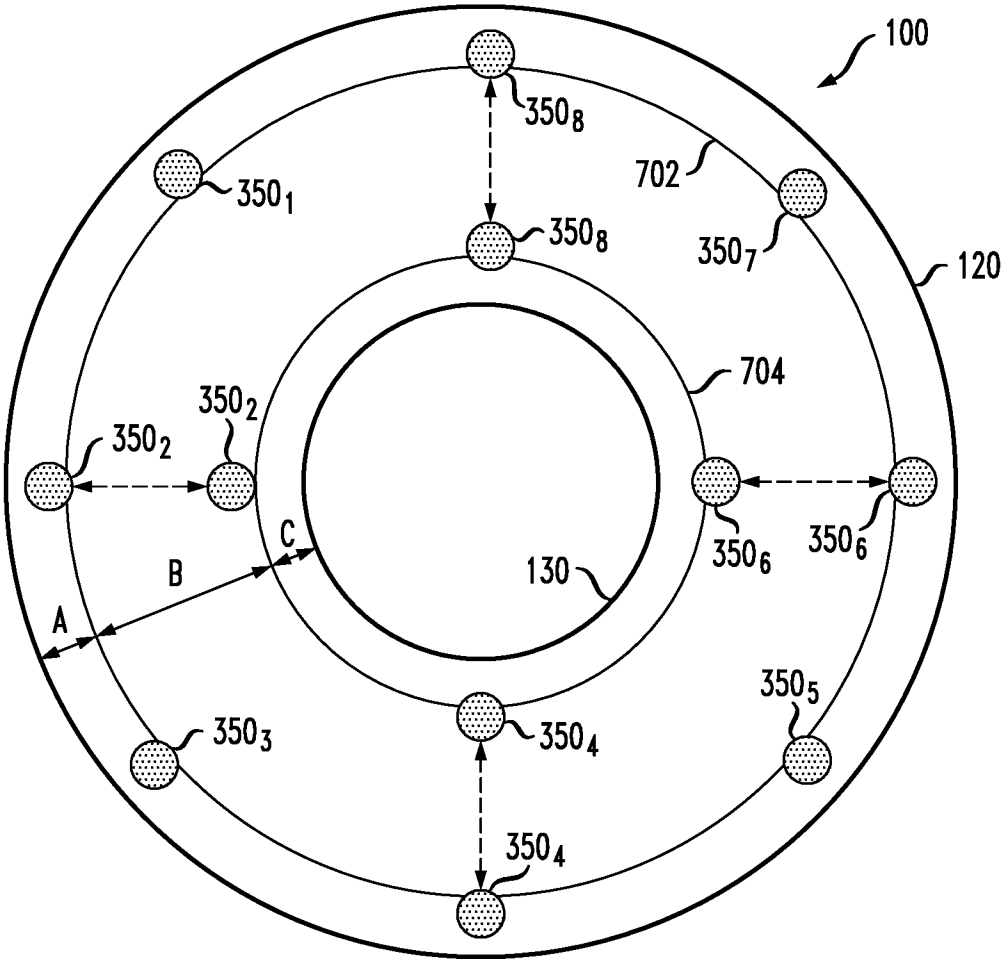
FIG. 8
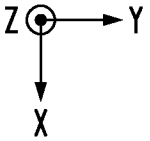

CABLE-COILING SYSTEM

CROSS-REFERENCE TO RELATED APPLICATIONS

This application claims the benefit of the filing date of European patent application no. 21306713.5 under 35 U.S.C. 119, the teachings of which application are incorporated herein by reference in their entirety.

BACKGROUND

Field

Various example embodiments relate to cable-handling equipment, and more specifically but not exclusively, to equipment for coiling communications cables.

Description of the Related Art

This section introduces aspects that may help facilitate a better understanding of the disclosure. Accordingly, the statements of this section are to be read in this light and are not to be understood as admissions about what is in the prior art or what is not in the prior art.

A submarine communications cable is a cable laid on or buried under the seabed between landing stations to carry telecommunication signals across stretches of ocean and/or sea. Such a cable may comprise one or more optical fibers capable of transporting optical data signals over large distances. The optical fibers are typically covered with silicone gel and then sheathed in various layers of polyethylene, steel wiring, copper, and polypropylene to provide insulation and shielding and to protect the fibers from possible physical damage.

Submarine communications cables are laid using ships designed and/or modified specifically for that purpose. Such ships can typically carry thousands of kilometers of cable out to sea, laying the cable-plant infrastructure on the seabed. Special subsea ploughs may be used to trench and bury the cables along the seabed, e.g., in areas relatively close to shorelines where naval activities, such as anchoring and fishing, are prevalent and present a damage danger to the cables.

SUMMARY OF SOME SPECIFIC EMBODIMENTS

Disclosed herein are various embodiments of an automated system for coiling a large (e.g., >1000 km) length of cable in a cable tank. In an example embodiment, the system comprises a gantry positioned above the cable tank and a swarm of cable-handling robots deployed on the floor of the cable tank. The gantry operates to controllably move a touchdown point of the cable, which is being fed into the cable tank by a cable engine. Each of the cable-handling robots is equipped with a rake that can be used to push or pull downed sections of the cable on the floor of the cable tank. An electronic controller operates to control the speed of the cable engine and movements of the gantry and individual cable-handling robots to coil the cable in the tank in spirally wound, vertically stacked layers.

Different embodiments of the automated cable-coiling system may be adapted for use at the cable factory and on board a cable-laying ship.

According to an example embodiment, provided is an apparatus, comprising: a movable head to guide a hanging section of a cable; a plurality of movable robots, each of the robots having one or more rakes for moving downed sections of the cable; and an electronic controller to coordinate movements of the movable head and individual ones of the robots to coil the cable in spirally wound, vertically stacked, horizontal layers.

According to another example embodiment, provided is an automated cable-coiling method, comprising the steps of: guiding a hanging section of a cable using a movable head; moving downed sections of the cable using rakes of a plurality of movable robots; and coordinating movements of the movable head and individual ones of the robots using an electronic controller to coil the cable in spirally wound, vertically stacked, horizontal layers.

BRIEF DESCRIPTION OF THE DRAWINGS

Other aspects, features, and benefits of various disclosed embodiments will become more fully apparent, by way of example, from the following detailed description and the accompanying drawings, in which:

FIG. 4 shows a schematic top view of a portion of the automated cable-coiling system of FIG. 3 according to an embodiment;

FIG. 8 schematically illustrates a variable number of cable-handling robots that may be actively engaged in cable coiling in the automated cable-coiling system of FIG. 3 according to an embodiment.

DETAILED DESCRIPTION

Figure 1:
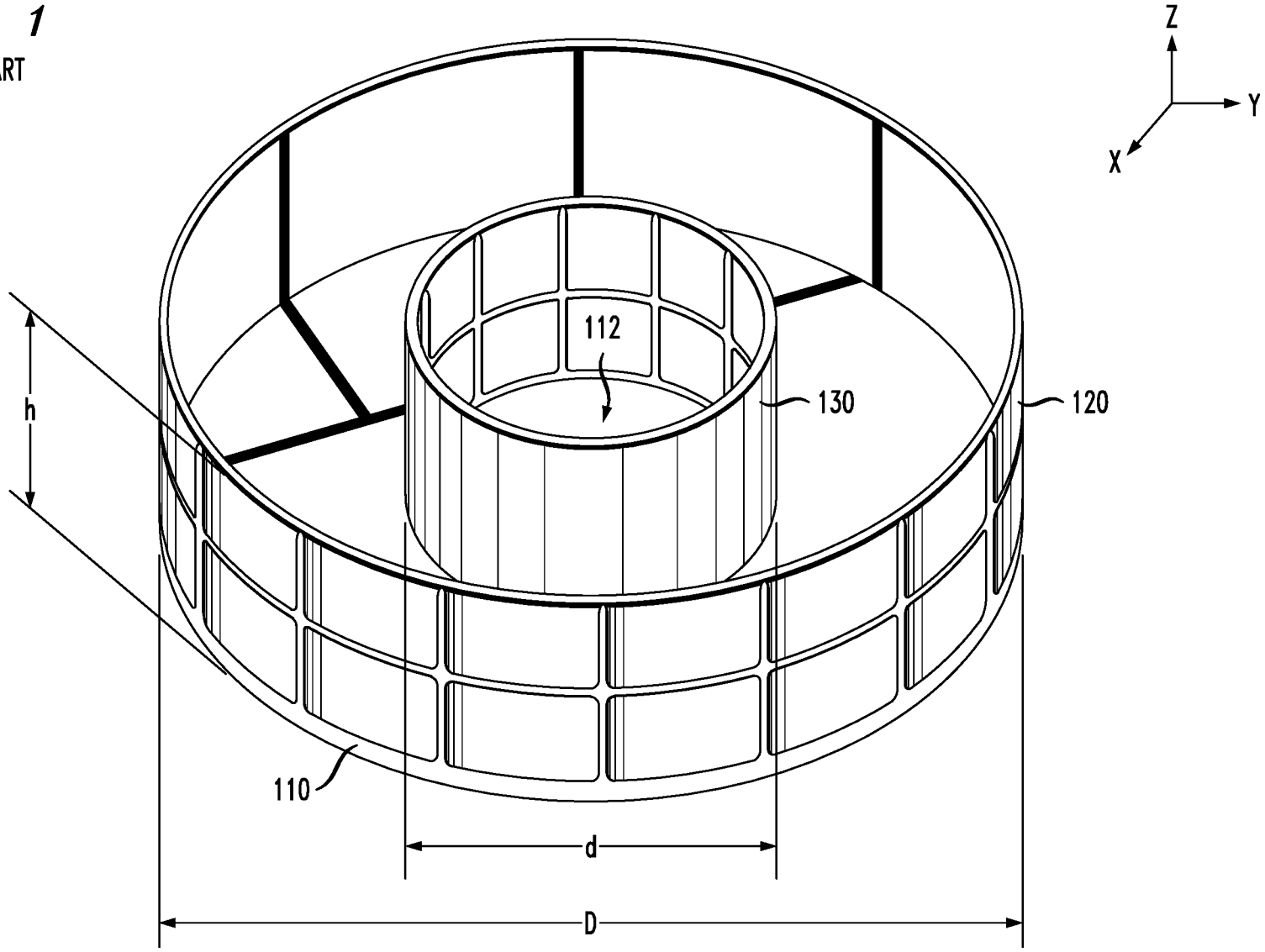
FIG. 1 PRIOR ART
FIG. 1 shows a three-dimensional perspective view of a cable tank using which at least some example embodiments may be practiced.

FIG. 1 shows a three-dimensional perspective view of a cable tank 100 using which at least some example embodiments may be practiced. Cable tank 100 comprises a base 110 having a substantially planar top surface and a generally circular shape with a circular opening 112 in the middle thereof. In the shown view, the top surface of base 110 is parallel to the XY-plane of the shown XYZ-coordinate triad. Cable tank 100 further comprises: (i) an outer circular (e.g., cylindrical) wall 120 attached to an outer edge of base 110, and (ii) an inner circular (e.g., cylindrical) wall 130 attached to base 110 at the perimeter of circular opening 112. Circular walls 120 and 130 are typically coaxial. The center axis of circular walls 120 and 130 is parallel to the Z-axis of the shown XYZ-coordinate triad. The height of the walls 120 and 130 is denoted as h. The outer diameter of planar base 110 is denoted as D. The diameter of circular opening 112 is denoted as d. In an example embodiment, cable tank 100 may have the following approximate sizes: h=10 m; d=5 m;

and D=15 m. In alternative embodiments, cable tank 100 may have other sizes, e.g., selected to accommodate the desired length of cable therein. For example, such cable length may be in the range between 500 km and 5000 km.

In some embodiments, inner wall 130 may be tilted toward opening 112, i.e., may have a conical shape.

Cable tanks similar to cable tank 100 may be used at factories during the cable-manufacturing process and on cable-laying ships.

Figure 2C:
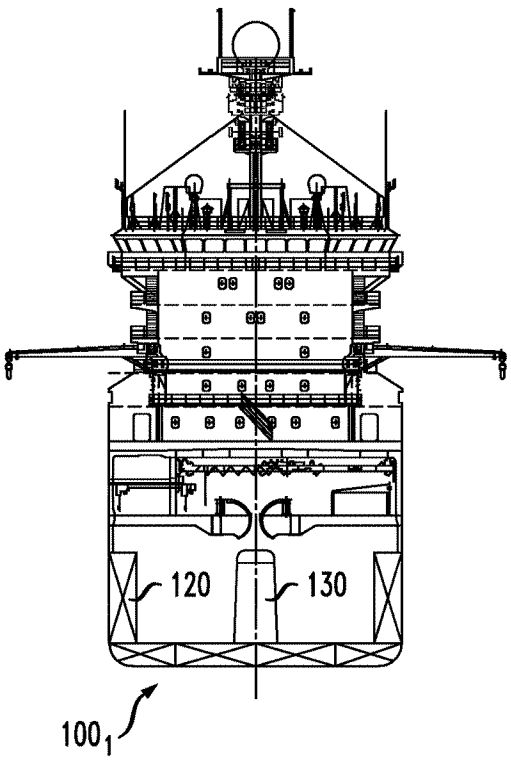
FIG. 2C PRIOR ART
FIGS. 2A-2C show side, top, and cross-sectional aft views, respectively, of an example cable-laying ship that can be equipped with the cable tank of FIG. 1.
Figure 2A:
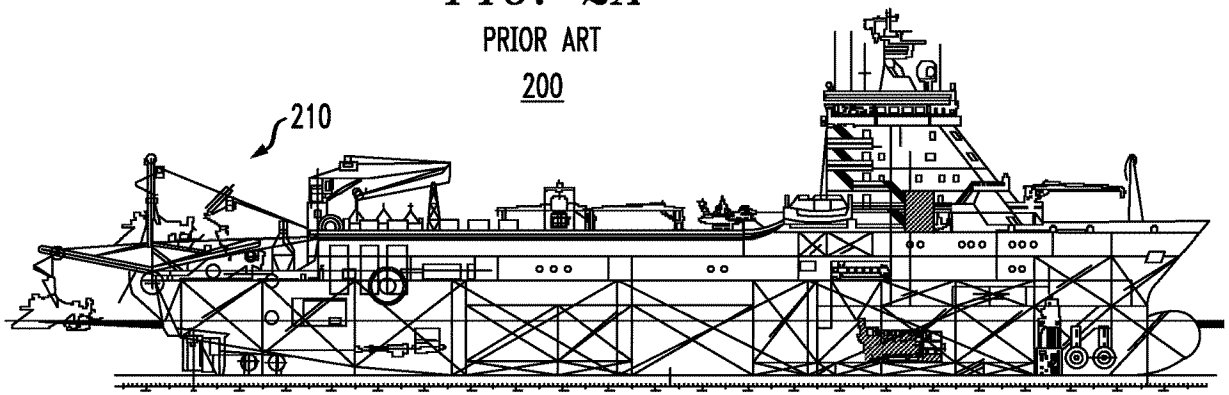
FIG. 2A PRIOR ART
Figure 2B:
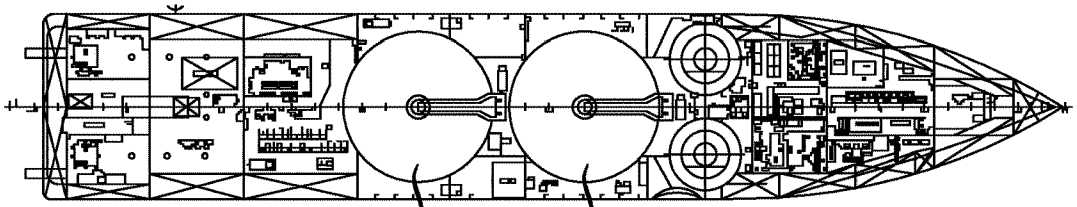
FIG. 2B PRIOR ART

FIGS. 2A-2C show side, top, and cross-sectional aft views, respectively, of an example cable-laying ship 200 equipped with two cable tanks 100, which are labeled $\mathbf{100}_1$ and $\mathbf{100}_2$. Cable-laying ship 200 may typically have a tonnage of over 10,000 tons. In some variants, cable-laying ship 200 may carry one or more than two cable tanks 100. As shown, cable-laying ship 200 may be capable of laying more than one line of underwater cable at the same time. In addition to cable tanks $\mathbf{100}_1$ and $\mathbf{100}_2$, cable-laying ship 200 may typically have a system 210 of stern sheaves designed to facilitate the cable-laying operation. After cables are loaded into the cable tanks $\mathbf{100}_1$ and $\mathbf{100}_2$ of cable-laying ship 200, e.g., at the port of origination, the ship may head out to sea to carry out cable installation. During such cable installation, the cable(s) may be fed out of cable tank(s) 100, through stern sheaves 210, and into a subsea plough (not explicitly shown in FIG. 2) for being buried in the seabed.

Submarine cables are typically manufactured at highly specialized factories, via a production flow, which may run continuously, 24 hours a day, for a number of weeks. During various production phases, the cable may be fed into a cable tank, e.g., similar to cable tank 100, for coiling therein by a team of human workers. On the same cable length, the coiling operation may need to be performed several times, e.g., once at each one of the manufacturing, integration, and ship-loading steps. When performed in a conventional manner, such coiling operations may disadvantageously be very time-consuming, tedious, and manual-labor intensive. For example, musculoskeletal disorders are not infrequent in workers involved in such coiling operations.

At least some of the above-indicated problems in the state of the art can beneficially be addressed using at least some embodiments of the automated cable-coiling system disclosed herein. Example benefits of this system may include significant reduction in the amount of manual labor and, in at least some cases, a higher speed of the coiling operation compared to that of manual coiling.

Figure 3:
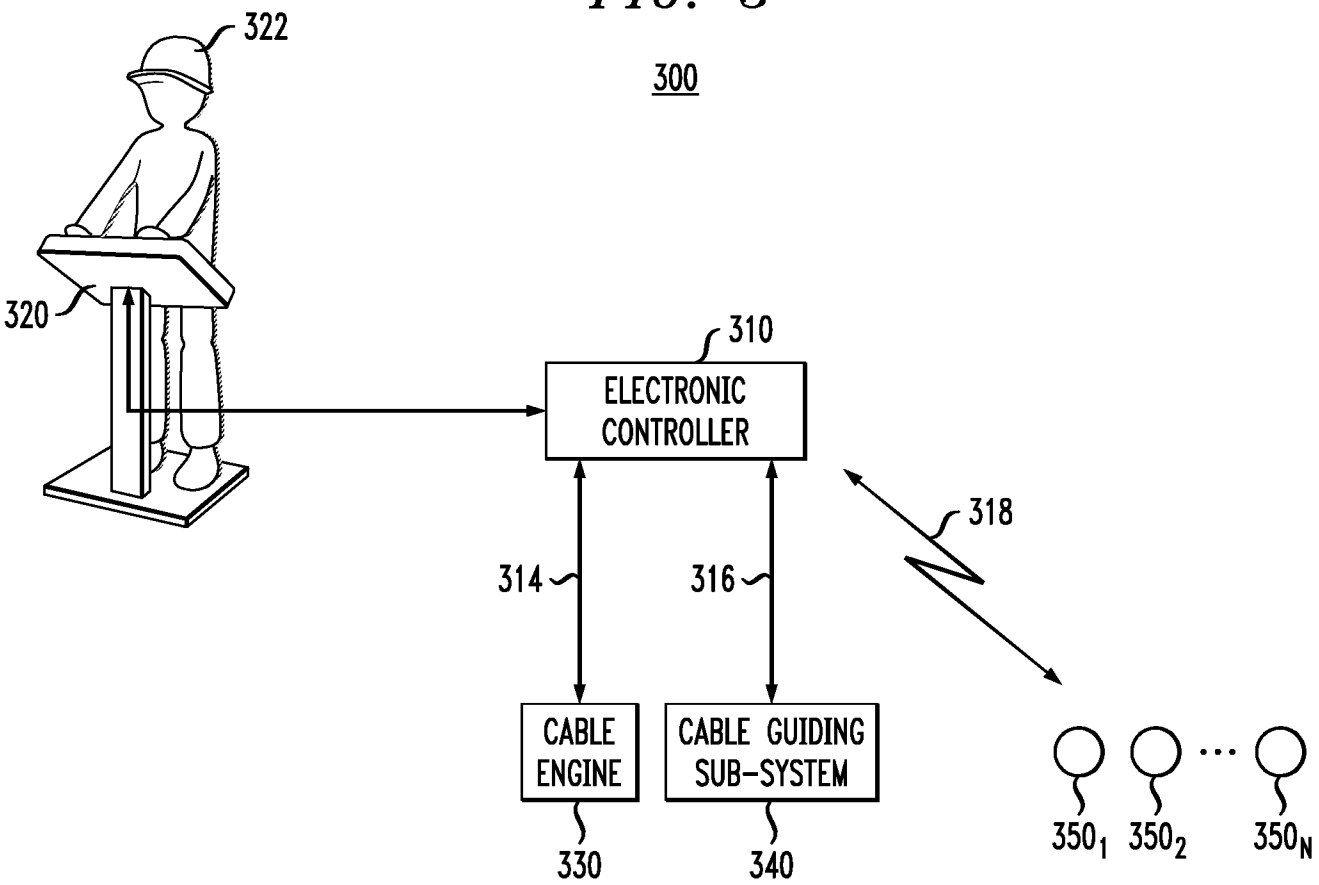
FIG. 3 shows a block diagram of an automated cable-coiling system according to an embodiment.

FIG. 3 shows a block diagram of an automated cable-coiling system 300 according to an embodiment. System 300 comprises an electronic controller 310 operatively connected to control a cable engine 330, a cable-guiding sub-system 340, and cable-handling robots $\mathbf{350}_1$-$\mathbf{350}_N$. In an example embodiment, the number N depends on the dimensions of the used cable tank 100 and can be, e.g., in the range between 4 and 20. System 300 further comprises a human-machine interface (HMI) 320 that can be used, e.g., to communicate to a human operator 322 various configuration parameters and/or the operating status of different parts of the system. HMI 320 may also be used to enable human operator 322 to manually enter certain commands, to stop and resume the cable-coiling process, and/or to change certain configuration parameters of system 300. In an example embodiment, electronic controller 310 may communicate with cable engine 330 and cable-guiding sub-system 340 using wireline connections 314 and 316, respectively, and with cable-handling robots $\mathbf{350}_1$-$\mathbf{350}_N$ using wireless links 318.

Cable engine 330 may comprise a motor and one or more cable-feeding sheaves for longitudinally moving (e.g., translating, pulling) the cable from a cable source toward cable tank 100 for being coiled therein. Cable-guiding sub-system 340 may operate to guide a hanging section of the cable to a proper touchdown point inside cable tank 100. The touchdown point may typically be continuously moving, e.g., approximately on a circular trajectory inside cable tank 100. Cable-handling robots $\mathbf{350}_1$-$\mathbf{350}_N$ may operate to: (i) arrange the downed sections of the cable in spiral loops, e.g., such that a next loop of the cable is in direct physical contact with the previous loop thereof; and (ii) keep one or more edge cable loops in a proper position until those cable loops are stabilized and locked therein by the subsequently laid cable loops.

Example embodiments of cable-guiding sub-system 340 and cable-handling robot $\mathbf{350}_n$ (n=1, 2, . . . , N) are described in more detail below in reference to FIGS. 4 and 6. Example movements of cable-handling robots $\mathbf{350}_1$-$\mathbf{350}_N$ during cable coiling are described in more detail below in reference to FIGS. 5-8.

Different suitable embodiments of system 300 may be used for cable coiling at the cable factory and on the deck of cable-laying ship 200.

FIG. 4 shows a schematic top view of a portion 400 of system 300 according to an embodiment. Portion 400 includes cable tank 100 (also see FIG. 1) in which a cable 402 is being coiled. Only a relatively short section of cable 402 is explicitly shown in FIG. 4 for illustration purposes. In some cases, cable 402 may be pre-torqued during production, e.g., for being coiled in the clockwise direction. As already indicated above, the full length of cable 402 can be, e.g., >1000 km. The XYZ-coordinate triad shown in FIG. 4 has the same orientation with respect to cable tank 100 as that shown in FIG. 1.

Herein, the term "horizontal" refers to a direction or plane that is substantially (e.g., to within 20 degrees) parallel to the XY-coordinate plane. The term "vertical" refers to a direction that is substantially (e.g., to within 20 degrees) parallel to the Z-coordinate. For example, the force of gravity may be vertical.

An example coiling operation is typically directed at placing cable 402 inside cable tank 100, e.g., by spirally winding the cable in a clockwise direction, about inner circular wall 130 (also see FIG. 1). The spiral winding may produce spirally wound, horizontal layers of cable 402, which are vertically stacked, starting from the first layer laid on the top surface of base 110, with subsequent layers progressing toward the top of cable tank 100, preferably without holes, crossings of the cable in the radial direction, or other winding imperfections.

In the shown embodiment, system 300 comprises stationary rails $\mathbf{410}_1$ and $\mathbf{410}_2$ positioned above cable tank 100, i.e., at a suitable height above base 110 thereof that is greater than the height h of the walls 120, 130 (also see FIG. 1). System 300 further comprises a rail 420 movably mounted on stationary rails $\mathbf{410}_1$ and $\mathbf{410}_2$. Rail 420 may be oriented approximately orthogonally with respect to rails $\mathbf{410}_1$ and $\mathbf{410}_2$, as indicated in FIG. 4.

In operation, rail 420 can be translated along stationary rails $\mathbf{410}_1$ and $\mathbf{410}_2$ parallel to the X-coordinate axis as indicated by the double-headed arrows shown in FIG. 4 next to the ends of rail 420. In an example embodiment, such translation of rail 420 can be performed, e.g., by moving rail 420 along stationary rails $\mathbf{410}_1$ and $\mathbf{410}_2$ on track wheels or rollers using an electric motor (not explicitly shown in FIG. 4). Electronic controller 310 may control the position of rail 420 on stationary rails $410_1$, $410_2$, e.g., by controlling the electric motor via control link 316 (also see FIG. 3).

System 300 further comprises a cable-guiding head 430 movably mounted on rail 420. In operation, cable-guiding head 430 can be translated along rail 420 parallel to the Y-coordinate axis as indicated by the double-headed arrow shown in FIG. 4 next to the cable-guiding head. In an example embodiment, such translation of cable-guiding head 430 can be performed, e.g., by moving the cable-guiding head along rail 420 on rail wheels using another electric motor (not explicitly shown in FIG. 4). Electronic controller 310 may control the position of cable-guiding head 430 with respect to rail 420, e.g., by controlling the corresponding electric motor via control link 316 (also see FIG. 3). Thus, by moving rail 420 along stationary rails $410_1$, $410_2$ and by moving cable-guiding head 430 along rail 420, system 300 can controllably position cable-guiding head 430 directly over any area of base 110 of cable tank 100.

In different embodiments, the rails $410_1$, $410_2$, and 430 may be implemented as parts of a gantry, a gantry crane, or an overhead crane.

In an example embodiment, cable-guiding head 430 has a cable-feedthrough channel, e.g., a ring, through which cable engine 330 can advance new sections of cable 402 toward cable tank 100. The cable-feedthrough channel may typically have an inner diameter that may be slightly larger than the diameter of cable 402. Such inner diameter may be selected such as to sufficiently laterally confine the cable without hindering the flow thereof through the channel or damaging the cable's exterior.

Cable-guiding head 430 also has cable-positioning sensors 432, 434 mounted thereon. In operation, cable-positioning sensors 432, 434 provide, e.g., via control link 316, appropriate cable telemetry to electronic controller 310 to enable system 300 to autonomously and controllably move the touchdown point of cable 402 across the floor of cable tank 100 while new sections of the cable are being fed through cable-guiding head 430 by cable engine 330. Such telemetry may monitor the catenary shape of the hanging section of cable 402. Based on the input received from cable-positioning sensors 432, 434, electronic controller 310 may appropriately operate the above-mentioned electric motors, thereby moving rail 420 and cable-guiding head 430 to correspondingly move the touchdown point of cable 402 along a suitable trajectory inside cable tank 100. When needed, electronic controller 310 can adjust the catenary shape, e.g., by changing the linear speed with which cable engine 330 dispenses cable 402 and/or the speed, position, and/or trajectory of cable-guiding head 430.

The embodiment shown in FIG. 4 corresponds to N=8, i.e., there are eight cable-handling robots $350_n$, which are labeled $350_1$-$350_8$. In an example embodiment, a cable-handling robot $350_n$ may be equipped with one or more rakes capable of catching, keeping, holding, pushing, and pulling sections of cable 402. In operation, each cable-handling robot $350_n$ may: (i) move to a floor position specified by electronic controller 310; (ii) use on-board positioning sensors to determine its position within cable tank 100 and report the determined position back to electronic controller 310; (iii) use on-board cable-reconnaissance sensors to detect a section of cable 402 to be handled; (iv) hook, grab, or engage the cable section; (v) disengage from the cable section as may be needed; (vi) move along the radial direction toward outer wall 120 or toward inner wall 130 of cable tank 100; (vii) move laterally along the downed sections of cable 402 as needed; and (viii) push or pull a section of cable 402 in the radial direction. Cable-handling robots $350_1$-$350_N$ may perform some of these actions on the cable sections autonomously, while electronic controller 310 may individually control some other actions of individual ones of cable-handling robots $350_1$-$350_N$ via respective control links 318. The different actions of cable-handling robots $350_1$-$350_N$ may typically be coordinated and directed at properly advancing the cable-coiling operation. An example embodiment of cable-handling robot $350_n$ is described in more detail below in reference to FIG. 6.

Figure 5A:
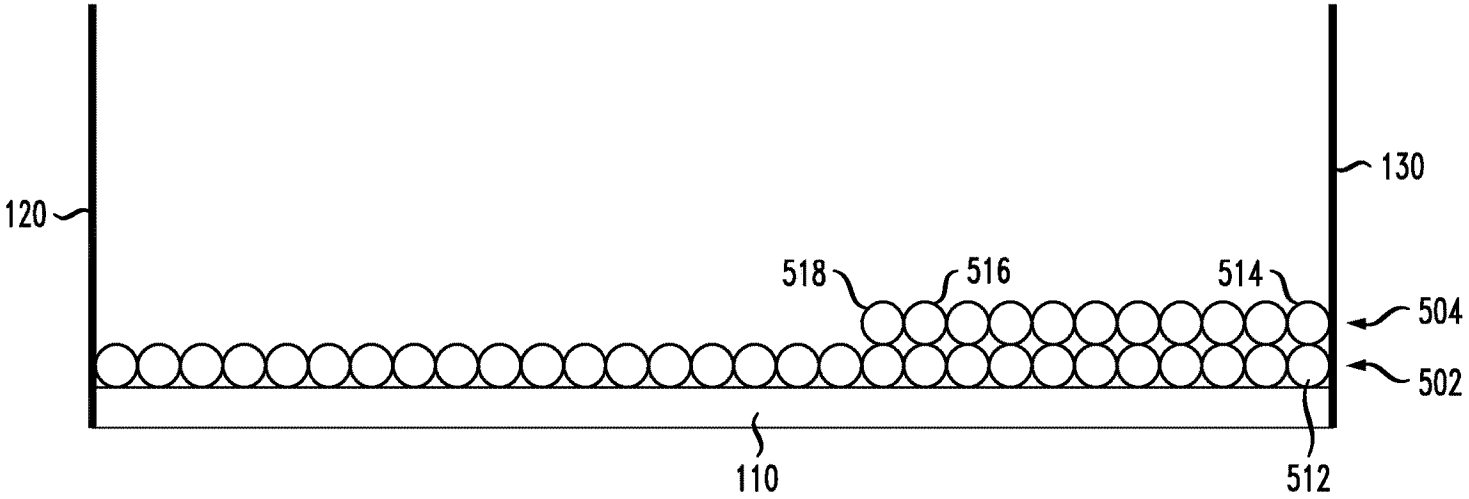
FIGS. 5A-5B show example cross-sectional views of a partially filled cable tank used in the automated cable-coiling system of FIG. 4 according to an embodiment.
Figure 5B:
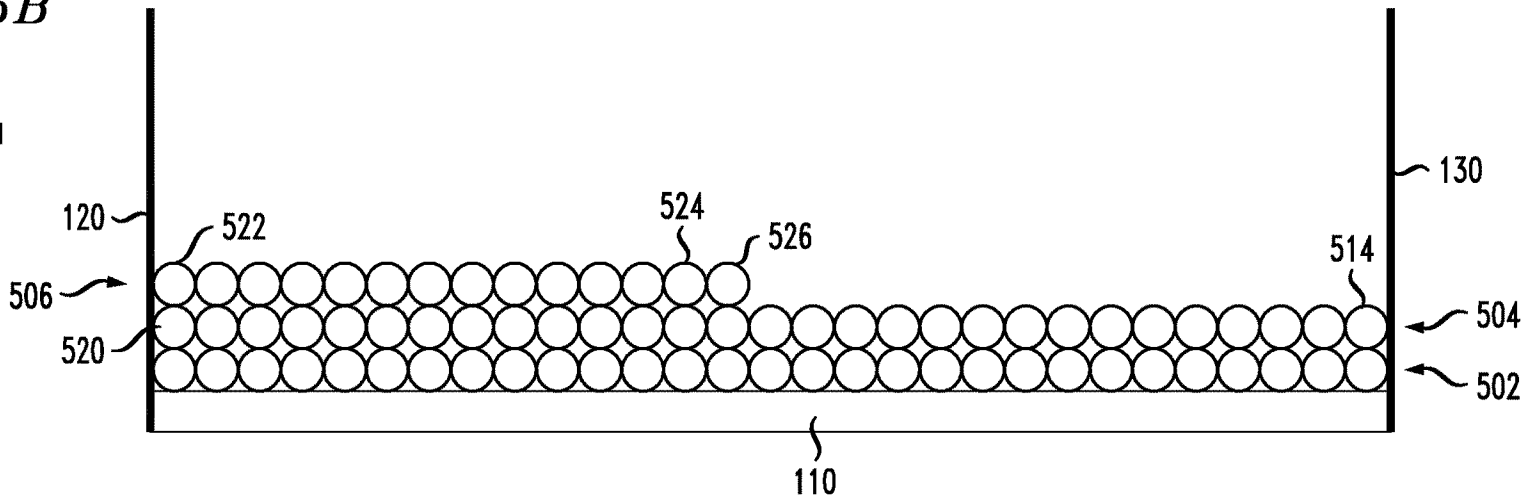

FIGS. 5A-5B show example cross-sectional views of a partially filled cable tank 100 used in the automated cable-coiling system 300 of FIG. 4 according to an embodiment. Each of the shown cross-sectional views corresponds to a cross-sectional plane AA indicated in FIG. 4. FIG. 5A corresponds to a first time, $t_1$, during coiling of cable 402 in cable tank 100. FIG. 5B corresponds to a second time, $t_2$, during coiling of cable 402 in cable tank 100, where $t_2>t_1$.

Referring to FIG. 5A, by time $t_1$, the cable-coiling operation progressed to a cable configuration in which: (i) a complete spirally wound first layer 502 of cable 402 has been laid directly on the top surface of base 110; and (ii) a partially completed, spirally wound second layer 504 of cable 402 has been laid directly on top of layer 502. In this particular example, the first layer 502 is formed by placing an end section of cable 402 next to the outer wall 120 of cable tank 100 and then spirally winding the cable in the clockwise direction in quasi-circular, closely packed loops of gradually decreasing diameter toward the inner cylindrical wall 130 of the cable tank. Once a last loop 512 of layer 502 is laid next to wall 130, a first loop 514 of layer 504 is wound in the clockwise direction about the inner cylindrical wall 130 on top of loop 512. The spiral winding of cable 402 then proceeds in the clockwise direction, in quasi-circular, closely packed loops of gradually increasing diameter, toward the outer cylindrical wall 120 of cable tank 100. At time $t_1$, a cable loop 518 is an edge cable loop of layer 504. Around this time, cable-handling robots $350_1$-$350_N$ may operate to engage different downed sections of cable 402 and shape the edge loop 518, e.g., by pressing the respective engaged cable sections thereof against the preceding cable loop 516 to prevent uncoiling and to ensure relatively neat and tight packing of cable loops in layer 504.

Referring to FIG. 5B, by time $t_2$, the cable-coiling operation progressed to a cable configuration in which: (i) layer 504 has been completed; and (ii) a partially completed, spirally wound third layer 506 of cable 402 has been laid directly on top of layer 504. In this particular example, a first loop 522 of layer 506 is wound in the clockwise direction on top of a last loop 520 of layer 504. The spiral winding of cable 402 then proceeds in the clockwise direction, in quasi-circular, closely packed loops of gradually decreasing diameter, toward the inner cylindrical wall 130 of cable tank 100. At time $t_2$, a cable loop 526 is an edge cable loop of layer 506. Around this time, cable-handling robots $350_1$-$350_N$ may operate to engage different downed sections of cable 402 and shape the edge loop 526, e.g., by pressing the respective engaged cable sections against the preceding cable loop 524 to prevent uncoiling and to ensure relatively neat and tight packing of cable loops in layer 506.

Additional spirally wound, horizontal layers of cable 402 can be formed in the above-indicated manner to produce a vertical stack of spirally wound, horizontal layers of cable 402 in cable tank 110. When in-line objects of a larger diameter, such as optical joints, are present, the corresponding layer disturbances can be reduced or corrected, e.g., using a suitable filler material, such as dunnage. Some objects of even larger diameter, such as optical amplifiers, may be stored outside cable tank 100, e.g., as known to persons of ordinary skill in the pertinent art. In such cases, automated coiling may be briefly interrupted and then resumed after the corresponding in-line object is properly secured in the designated area. Some portions of the cable layers around disturbances caused by in-line objects may be tilted, i.e., have a sloped top surface.

The snapshots shown in FIGS. 5A-5B illustrate the ability of cable-handling robots $\mathbf{350}_1$-$\mathbf{350}_N$ to press cable sections of the edge cable loop in two opposite radial directions. For example, in the snapshot of FIG. 5A, cable-handling robots $\mathbf{350}_1$-$\mathbf{350}_N$ may be pressing cable sections of the edge loop, e.g., 518, toward the center of cable tank 100. In contrast, in the snapshot of FIG. 5B, cable-handling robots $\mathbf{350}_1$-$\mathbf{350}_N$ may be pressing cable sections of the edge cable loop, e.g., 526, toward the periphery of cable tank 100. FIG. 6 shows a schematic three-dimensional perspective view of a cable-handling robot $\mathbf{350}_n$ according to an embodiment. Robot $\mathbf{350}_n$ may have a weight between approximately 100 kg and 200 kg. Such weight enables robot $\mathbf{350}_n$ to properly handle cable 402 during the coiling operation, e.g., to steadily hold a section of the cable in place while new sections thereof are being lowered through cable-guiding head 430. In an example embodiment, robot $\mathbf{350}_n$ may have the following approximate dimensions: 1 m width, 1 m length, and 1 m height.

Figure 6:
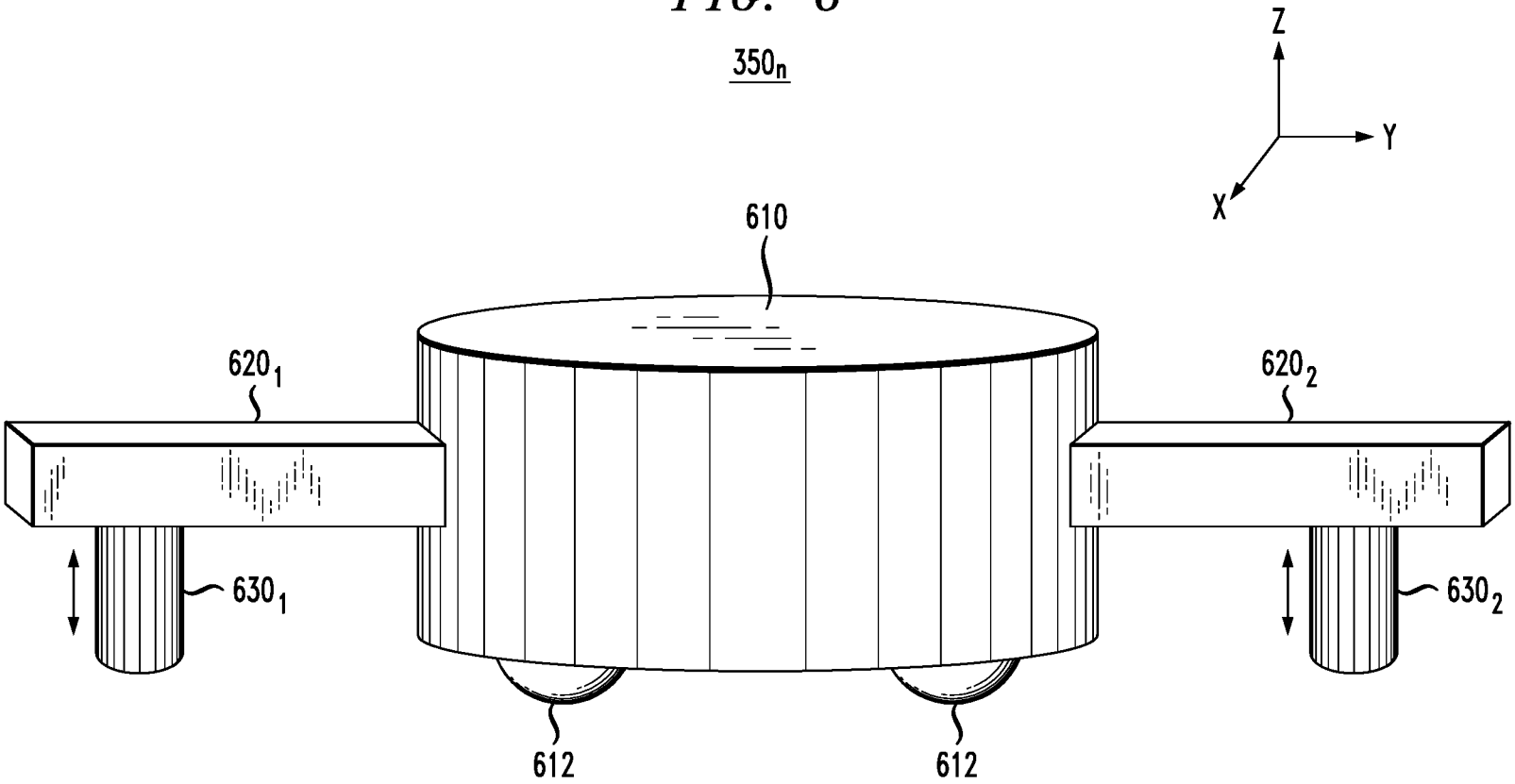
FIG. 6 shows a schematic three-dimensional perspective view of a cable-handling robot that can be used in the automated cable-coiling system of FIG. 3 according to an embodiment.

Robot $\mathbf{350}_n$ comprises a body 610 having a plurality of (e.g., three or four) wheels 612 with tires, only two of which are directly visible in the view of FIG. 6. Each wheel 612 may be connected to a respective dedicated motor (not explicitly shown in FIG. 6). Each of the motors may be individually controllable to enable robot $\mathbf{350}_n$ to make turns or to move along a straight line. The tires of wheels 612 may have no grooves (i.e., may be slick) to avoid having trapped therein any foreign objects that might possibly damage cable 402, e.g., when the wheels come into direct contact with the cable inside cable tank 100. The tires of wheels 612 may preferably be made of a rubbery material capable of providing sufficient traction for robot $\mathbf{350}_n$ to move/stand, without slipping or skidding, on top of the cable layers described in reference to FIGS. 5A-5B.

Robot $\mathbf{350}_n$ further comprises arms $\mathbf{620}_1$ and $\mathbf{620}_2$ fixedly attached to body 610. In an example embodiment, arms $\mathbf{620}_1$ and $\mathbf{620}_2$ may be horizontal and collinear, i.e., arranged to lie on a straight line passing through a middle portion of body 610. Extending down from the arms are cable rakes $\mathbf{630}_1$ and $\mathbf{630}_2$. Each of cable rakes $\mathbf{630}_1$ and $\mathbf{630}_2$ may be movable vertically, e.g., as indicated in FIG. 6 by the double-headed arrows. For example, in some embodiments, cable rakes $\mathbf{630}_1$ and $\mathbf{630}_2$ can be retracted into arms $\mathbf{620}_1$ and $\mathbf{620}_2$, respectively, to enable robot $\mathbf{350}_n$ to more-freely move inside cable tank 100 without catching cable 402. On the other hand, when a cable rake $\mathbf{620}_i$ (i=1, 2) is lowered, that cable rake can be used to tackle and hook a downed section of cable 402. In an example embodiment, cable rakes $\mathbf{630}_1$ and $\mathbf{630}_2$ may have suitable shapes and be covered with rubber or relatively soft plastic to prevent any possible damage to cable 402.

Referring to FIG. 5B, when robot $\mathbf{350}_n$ is working inside cable tank 100, wheels 612 thereof may be on top of partially completed cable layer 506. In this case, robot $\mathbf{350}_n$ can position itself such that, for example, arm $\mathbf{620}_2$ extends over the edge of partially completed cable layer 506. Cable rake $\mathbf{630}_2$ can then be lowered such that the bottom end thereof almost touches the top of the corresponding completed cable layer 504, i.e., be lowered below the bottom level of wheels 612. After cable rake $\mathbf{630}_2$ is lowered in this manner, robot $\mathbf{350}_n$ can move in the radial direction toward outer wall 120 such that the corresponding section of edge cable loop 526 is pulled by the cable rake into a desired position next to cable loop 524, e.g., without any slack or other winding imperfections. Once that section of edge cable loop 526 is raked into a proper position, robot $\mathbf{350}_n$ can steadily hold it there for some time, e.g., until other sections of edge cable loop 526 are similarly raked in and secured by other robots to substantially lock the held section of cable loop 526 in place. At that time, robot $\mathbf{350}_n$ can retract cable rake $\mathbf{630}_2$ and back off from the edge of the partially completed cable layer 506 to allow new sections of cable 402 to be lowered next to the secured section of edge cable loop 526. This process can then be repeated in the same manner to properly form a new edge cable loop next to cable loop 526.

Alternatively, wheels 612 of robot $\mathbf{350}_n$ may be on top of the fully completed cable layer 504. In this case, robot $\mathbf{350}_n$ can position itself such that, for example, arm $\mathbf{620}_1$ does not extend over the edge of partially completed cable layer 506. Cable rake $\mathbf{630}_1$ can then be lowered such that the bottom end thereof almost touches the top of cable layer 504, i.e., be lowered to the level slightly above the bottom level of wheels 612. After cable rake $\mathbf{630}_1$ is lowered in this manner, robot $\mathbf{350}_n$ can move in the radial direction toward outer wall 120 such that the corresponding section of edge cable loop 526 is pushed by the cable rake into a desired position next to cable loop 524, e.g., without any slack or other winding imperfections. Once that section of edge cable loop 526 is raked into a proper position, robot $\mathbf{350}_n$ can steadily hold it there for some time, e.g., until other sections of edge cable loop 526 are similarly raked in and secured by other robots to substantially lock the held section of cable loop 526 in place. At that time, robot $\mathbf{350}_n$ can retract cable rake $\mathbf{630}_1$ and back off from the edge of partially completed cable layer 506 to allow new sections of cable 402 to be lowered next to the secured section of edge cable loop 526. This process can then be repeated in the same manner to properly form a new edge cable loop next to cable loop 526.

In some cases, robot $\mathbf{350}_n$ may need to move across the edge cable loop, e.g., to change its position from being located directly on top of fully completed layer 504 to being located directly on top of partially completed layer 506, or vice versa. Wheels 612 may preferably have a sufficiently large diameter and good traction to enable robot $\mathbf{350}_n$ to "climb," up or down, the step corresponding to the edge cable loop 526.

Referring back to FIG. 6, body 610 may have a plurality of on-board positioning sensors and/or cameras (not explicitly shown in FIG. 6).

For example, body 610 may have one or more positioning sensors to determine the position of robot $\mathbf{350}_n$ inside cable tank 100. In an example embodiment, such a positioning sensor may be implemented using an upward-facing camera. A ceiling above cable tank 100 may have painted thereon a reference pattern, which such camera may capture. The corresponding video frame can then be processed to determine the position of robot $\mathbf{350}_n$. Wireless link 318 may then be used to communicate the determined position to electronic controller 310.

In an alternative embodiment, a distinguishing pattern may be painted on top of body 610, and downward-facing cameras may be installed at the ceiling above cable tank 100. Image frames captured by such cameras may then be processed to determine positions of different robots $\mathbf{350}_n$ inside cable tank 100.

Body 610 may further have one or more cable-reconnaissance sensors. In an example embodiment, such a cable-reconnaissance sensor may be implemented using a laser-based profilometer. A camera can be used, e.g., to distinguish different types and/or variants of cable 402. For example, such camera can be used to spot various cable markers. Some of such cable markers may also be used to indicate the presence of in-line objects, such as joining boxes, repeaters, etc.

Body 610 may further have one or more safety sensors. Such sensors may be used, e.g., to detect the presence of humans within a safety range around robot $\mathbf{350}_n$. Two areas may be defined around robot $\mathbf{350}_n$, a warning area and a "red" zone. When a person is detected within the warning area, robot $\mathbf{350}_n$ may inform operator 322, e.g., by sending a warning message. If a person enters the red zone, then robot $\mathbf{350}_n$ may send an alarm message to operator 322. In response to the latter message, operator 322 may perform an emergency stop of system 300. Additionally, body 610 may have an emergency stop button thereon, which can be used if needed to cause an immediate shutdown of the corresponding robot $\mathbf{350}_n$.

Body 610 may further have an easily accessible battery compartment for a replaceable battery pack. In an example embodiment, each battery pack may enable robot $\mathbf{350}_n$ to operate for 8 to 12 hours. Low energy consumption may be achieved by limiting the movements of individual robots, e.g., as described in more detail below in reference to FIGS. 7-8. When necessary, a technician may perform battery-pack replacement for robot $\mathbf{350}_n$ by briefly stopping the robot inside cable tank 100, i.e., without taking the robot out of the cable tank.

Figure 7:
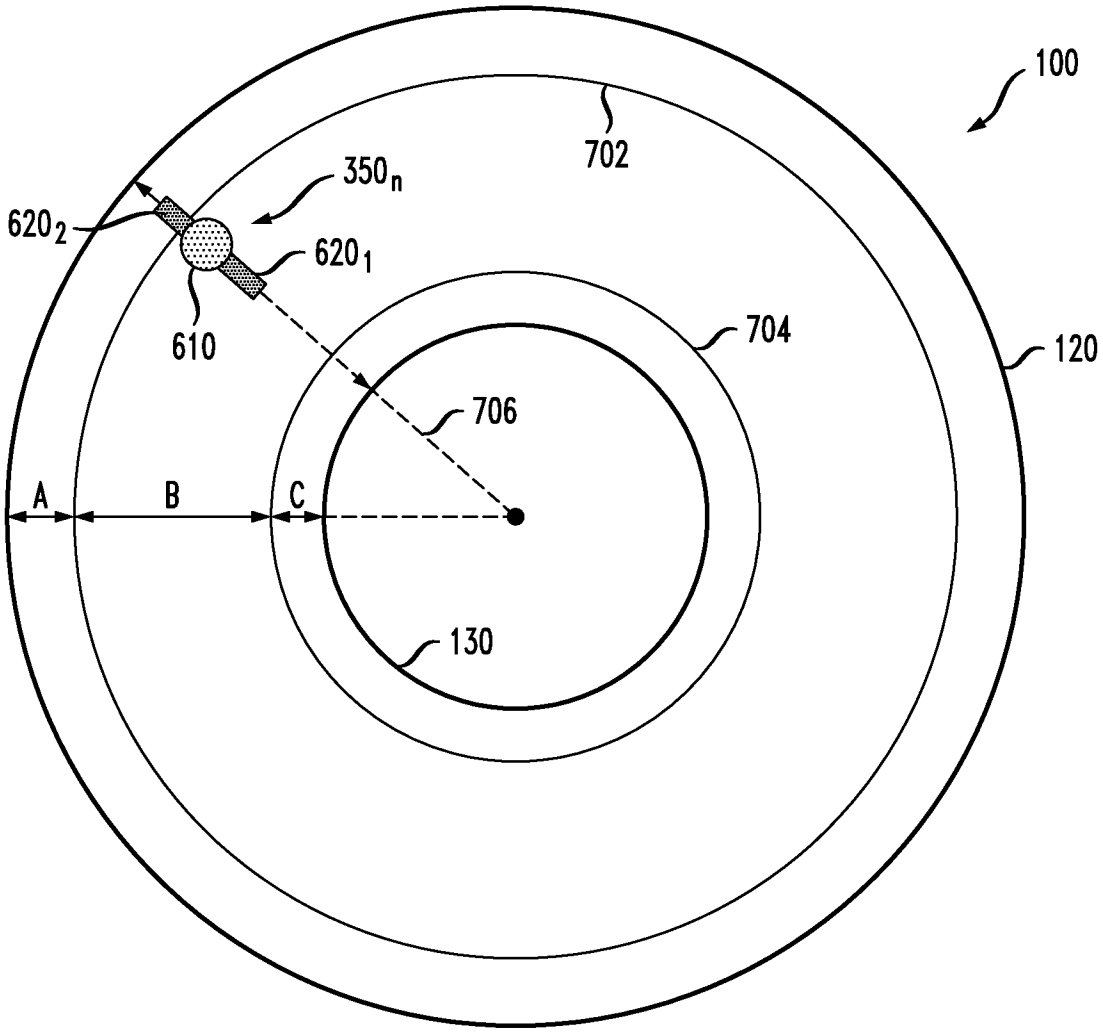
FIG. 7 schematically shows different operating zones for the cable-handling robot of FIG. 6 in the cable tank of FIG. 1 according to an embodiment.

FIG. 7 schematically shows different operating zones for robot $\mathbf{350}_n$ in cable tank 100 according to an embodiment. More specifically, FIG. 7 shows a schematic top view of cable tank 100, which is similar to the top view of FIG. 4. The floor of cable tank 100 is divided into three ring-shaped logical zones, labeled A, B, and C, respectively. Only one robot $\mathbf{350}_n$ is shown in FIG. 7 for illustration purposes. However, the shown zones A, B, and C may similarly be applied to additional robots $\mathbf{350}_n$ in cable tank 100.

Zone A is located between outer wall 120 and circle 702. In an example implementation, the width of zone A may approximately be the same as or slightly larger than one half of the arms span of robot $\mathbf{350}_n$, with the arms span being the distance between the unattached end of arm $\mathbf{620}_1$ and the unattached end of arm $\mathbf{620}_2$. Zone C is located between inner wall 130 and circle 704. The width of zone C may approximately be the same as the width of zone A. Zone B is located between circles 702 and 704. Other suitable zone widths may alternatively be implemented as well.

In operation, robot $\mathbf{350}_n$ may typically be oriented such that its arms $\mathbf{620}_1$ and $\mathbf{620}_2$ are approximately along a corresponding radial line 706, e.g., as indicated in FIG. 7. Most of the time, robot $\mathbf{350}_n$ may move in relatively small increments along radial line 706, toward inner wall 130 and/or outer wall 120, e.g., as explained in more detail below.

When cable 402 is being coiled in zone A, robot $\mathbf{350}_n$ may use arm $\mathbf{620}_2$ while body 610 primarily remains in zone B. More specifically, when the coiling is proceeding toward inner wall 130, robot $\mathbf{350}_n$ may use arm $\mathbf{620}_2$ to push the downed cable section toward outer wall 120 and/or the previously laid cable loop. When the coiling is proceeding toward outer wall 120, robot $\mathbf{350}_n$ may use arm $\mathbf{620}_2$ to pull the downed cable section toward the previously laid cable loop.

When cable 402 is being coiled in zone C, robot $\mathbf{350}_n$ may use arm $\mathbf{620}_1$ while body 610 primarily remains in zone B. More specifically, when the coiling is proceeding toward inner wall 130, robot $\mathbf{350}_n$ may use arm $\mathbf{620}_1$ to pull the downed cable section toward the previously laid cable loop. When the coiling is proceeding toward outer wall 120, robot $\mathbf{350}_n$ may use arm $\mathbf{620}_1$ to push the downed cable section toward inner wall 130 and/or the previously laid cable loop.

When cable 402 is being coiled in zone B, robot $\mathbf{350}_n$ may use either of the arms $\mathbf{620}_1$ and $\mathbf{620}_2$ to push or pull the downed cable section toward the previously laid cable loop.

FIG. 8 schematically illustrates a variable number of robots $\mathbf{350}_n$ that may be actively engaged in cable coiling in cable tank 100 according to an embodiment. More specifically, FIG. 8 shows a schematic top view of cable tank 100, which is similar to the top view of FIG. 7. As shown, there are eight robots, labeled $\mathbf{350}_1$-$\mathbf{350}_8$, deployed in cable tank 100. Arms 620 of the robots $\mathbf{350}_1$-$\mathbf{350}_8$ are not explicitly shown in FIG. 8 for simplification.

When cable 402 is being coiled in or close to zone A, all eight of the robots $\mathbf{350}_1$-$\mathbf{350}_8$ may be actively engaged in cable coiling, e.g., as described above. When cable 402 is being coiled in or close to zone C, only four of the robots $\mathbf{350}_1$-$\mathbf{350}_8$, illustratively the robots $\mathbf{350}_2$, $\mathbf{350}_4$, $\mathbf{350}_6$, and $\mathbf{350}_8$, may be actively engaged in cable coiling, while the remaining robots, illustratively the robots $\mathbf{350}_1$, $\mathbf{350}_3$, $\mathbf{350}_5$, and $\mathbf{350}_7$, may be idling, e.g., near outer wall 120. In an example embodiment, some of the $\mathbf{350}_1$-$\mathbf{350}_8$ may be controllably engaged/disengaged from the active cable coiling to maintain the distance between neighboring active robots in the range between approximately 2 m and approximately 4 m.

Typically, coiling on larger circles in zones A and B may rely on a larger number of robots $\mathbf{350}_n$, whereas coiling on smaller circles in zones B and C may rely on a smaller number of robots $\mathbf{350}_n$. An appropriate robot-management algorithm run by electronic controller 310 may be used to instruct selected robots $\mathbf{350}_n$ to either get involved in the cable-coiling operations or to sit idle outside the active cable-coiling area. The robot-management algorithm may take into account the remaining charge in the batteries of various robots $\mathbf{350}_n$ to alternate the robots used for coiling on the smaller circles in zones B and C, e.g., such that the usage time of different individual robots is approximately equalized.

In an example embodiment, system 300 may use appropriate software with different modules thereof running on electronic controller 310 and on-board controllers of individual robots $\mathbf{350}_n$ to orchestrate cooperative work of the robots and other parts of the system. The software may be used to implement at least the following phases: (i) initialization; (ii) normal operation; and (iii) charging.

During the initialization phase, system 300 may be operated to:

(a) Activate of cable-guiding sub-system 340. For example, operators may prepare the system by threading cable 402 through cable-guiding head 430 and placing several initial cable loops on the tank floor under manual control. The operators may also test cable engine 330 and communications between various parts of system 300;

(b) Deploy cable-handling robots $\mathbf{350}_n$ in cable tank 100. For example, technicians may place a selected number of robots $\mathbf{350}_n$ on the floor of cable tank 100. The number of robots may depend on the diameter D of cable tank 100. The robots may be placed inside cable tank 100 using a gantry crane or other suitable mechanism;

(c) Connect the deployed cable-handling robots $\mathbf{350}_n$ to electronic controller 310. For example, operator 322 may enter into the system the number of deployed robots $\mathbf{350}_n$ and their unique identifiers. Electronic controller 310 may then establish and test wireless links 318 with individual robots $\mathbf{350}_n$. The established wireless links 318 may then be used to log into electronic controller 310 the present positions of individual robots $\mathbf{350}_n$ on the floor of cable tank 100; and (d) Move the deployed cable-handling robots $\mathbf{350}_n$ to their appropriate initial positions. For example, a suitable algorithm may be run to determine an initial working position for each robot $\mathbf{350}_n$ and then send corresponding positioning commands to the robots via wireless links 318.

The initialization phase may be deemed completed, e.g., when: (i) each robot $\mathbf{350}_n$ is at its initial working position and is ready to operate, e.g., there are no warnings or alarms, the battery is sufficiently charged, and the communication channel is working properly; (ii) cable guiding sub-system 340 is ready, e.g., the power is on, the corresponding communication channels are on, the catenary shape is within acceptable limits, and cable tension is normal; and (iii) cable engine 330 is ready. When operator 322 gives the start order, the initial cable speed may be relatively low, e.g., approximately 10 m/min. The cable speed may then be gradually increased to a desired normal operating speed, e.g., to >20 m/min. If the normal operating speed is reached without warnings, alarms, or other issues, then system 300 may transition to the "normal operation" phase.

During the "normal operation" phase, system 300 may:

(e) Maintain proper operation of cable-guiding sub-system 340. For example, cable-positioning sensors 432, 434 may be used to monitor the catenary shape of the hanging section of cable 402 and trigger appropriate adjustments. If the catenary shape gets too close to its acceptable limits, then electronic controller 310 may correspondingly adjust the trajectory and/or speed of cable-guiding head 430. If this adjustment is insufficient to recover the acceptable catenary shape, then electronic controller 310 may instruct cable engine 330 to change (increase or decrease) the linear speed of cable 402. In some cases, human intervention and/or an emergency stop may be needed to address and correct a catenary-shape issue;

(f) Individually control different robots $\mathbf{350}_n$. For example, robots $\mathbf{350}_n$ may need to behave differently in different coiling zones (e.g., zones A-C, FIGS. 7-8), e.g., to push or pull downed sections of cable 402 as indicated above. Taking into account the specific coiling zone, orchestrated cooperative actions of multiple robots $\mathbf{350}_n$ may be implemented in accordance with the following example cyclical sequence of steps: (i) the robot closest to the cable-touchdown area operates to: tackle the corresponding cable section with a suitable one of the arms $\mathbf{620}_1$ and $\mathbf{620}_2$, push or pull the tackled cable section into a proper loop position using the corresponding rake $\mathbf{630}_1$ or $\mathbf{630}_2$, and hold that cable section steady and in place for a suitable period of time; (ii) one or more of the robots $\mathbf{350}_n$ preceding the robot of "step (i)" may continue holding their respective cable sections steady, in their proper coiled positions; and (iii) the remaining robots $\mathbf{350}_n$, i.e., the robots whose cable sections are sufficiently stabilized by the actions of the robots involved in "steps (i)-(ii)," may gradually move out of the cable-drop path to allow new sections of the cable to be lowered and to touch down;

(g) Control the number of active robots $\mathbf{350}_n$. For example, the number of robots needed for cable coiling in zone C may typically be smaller than the number of robots needed for cable coiling in zone A (e.g., see FIG. 8). Accordingly, electronic controller 310 may instruct some of the robots to temporarily park themselves along outer wall 120, out of the cable-drop path. The selection of robots to be parked in this manner may be based on the remaining battery charge. More specifically, the robots with relatively low remaining charges may be temporarily parked, while the robots with relatively high remaining charges may continue to be active; and (h) Control cable engine 330. For example, proper linear speed of cable 402 may depend on the cable type and on the type of coiling, e.g., initial, intermediate, transfer, or final. The linear speed of cable 402 may also depend on the cable-coiling zone, e.g., with a higher speed in zone A than in zone C (also see FIGS. 7-8). Electronic controller 310 may therefore run a suitable speed-control algorithm, which takes into account these and possibly other parameters of the cable-coiling process.

Various elements of system 300 (e.g., robots $\mathbf{350}_n$, cable-guiding sub-system 340, cable engine 330, electronic controller 310, and operator 322) may cause electronic controller 310 to implement an emergency stop at any time. Some of the reasons for an emergency stop may include but are not limited to: (i) presence of humans in the red zone around any one of the active robots $\mathbf{350}_n$; (ii) entangled cable; (iii) cable tension exceeding a fixed threshold; (iv) unacceptable catenary shape; (v) one of the robots $\mathbf{350}_n$ is in the cable-drop path; (vi) loss of communications with any critical element of the system; (vii) a manually entered command from operator 322; and (viii) activation of the emergency stop button on any of robots $\mathbf{350}_n$.

When the coiling operation is halted or terminated, some or all of robots $\mathbf{350}_n$ may be lifted out of cable tank 100. If charging is needed, some robots $\mathbf{350}_n$ may be directed to a charging station. For example, those robots $\mathbf{350}_n$, still being connected to electronic controller 310, may be instructed to proceed to a selected one of the available battery-charging stations for battery replenishment. To facilitate safe transit thereto, dedicated robot-transit paths may be established on the factory floor. The robot-transit speed may be limited, e.g., to <3 km/h. The charged robots may then move along the same paths back to cable tank 100 and be transferred into the cable tank for further cable-coiling operations therein.

According to an example embodiment disclosed above, e.g., in the summary section and/or in reference to any one or any combination of some or all of FIGS. 1-8, provided is an apparatus comprising: a movable head (e.g., 430, FIG. 4) to guide a hanging section of a cable (e.g., 402, FIG. 4); a plurality of movable robots (e.g., $\mathbf{350}_n$, FIG. 4), each of the robots having one or more rakes (e.g., $\mathbf{630}_1$, $\mathbf{630}_2$, FIG. 6) for moving downed sections of the cable; and an electronic controller (e.g., 310, FIG. 3) to coordinate movements of the movable head and individual ones of the robots to coil the cable in spirally wound, vertically stacked, horizontal layers (e.g., 502-506, FIG. 5B).

In some embodiments of the above apparatus, the apparatus further comprises: first and second parallel stationary rails (e.g., $\mathbf{410}_1$, $\mathbf{410}_2$, FIG. 4); and a third rail (e.g., 420, FIG. 4) mounted on and translatable along the first and second parallel stationary rails; and wherein the movable head is mounted on and translatable along the third rail.

In some embodiments of any of the above apparatus, the apparatus further comprises a cable tank (e.g., 100, FIG. 4) to hold the spirally wound, vertically stacked, horizontal layers of the cable.

In some embodiments of any of the above apparatus, the cable tank comprises a circular horizontal base (e.g., 110, FIG. 1) and outer and inner walls (e.g., 120, 130, FIG. 1) attached to the base; and wherein the robots are positioned to move in the cable tank between the outer and inner walls.

In some embodiments of any of the above apparatus, the apparatus further comprises one or more sensors (e.g., 432, 434, FIG. 4) to monitor catenary shape of the hanging section.

In some embodiments of any of the above apparatus, at least one of the one or more sensors is mounted on the movable head.

In some embodiments of any of the above apparatus, the electronic controller is configured to adjust movements of the movable head in response to monitoring data received from the one or more sensors.

In some embodiments of any of the above apparatus, the movable head and robots are operable, in communication with the electronic controller, to coil at least 1000 km of the cable in the spirally wound, vertically stacked, horizontal layers.

In some embodiments of any of the above apparatus, the individual ones of the robots are configured to communicate with the electronic controller via respective wireless links (e.g., 318, FIG. 3).

In some embodiments of any of the above apparatus, the apparatus further comprises an engine (e.g., 330, FIG. 3) to feed sections of the cable to the movable head.

In some embodiments of any of the above apparatus, the cable comprises one or more optical fibers.

In some embodiments of any of the above apparatus, the cable is a submarine communications cable.

According to another example embodiment disclosed above, e.g., in the summary section and/or in reference to any one or any combination of some or all of FIGS. 1-8, provided is an automated cable-coiling method, comprising the steps of: guiding a hanging section of a cable (e.g., 402, FIG. 4) using a movable head (e.g., 430, FIG. 4); moving downed sections of the cable using rakes (e.g., $\mathbf{630}_1$, $\mathbf{630}_2$, FIG. 6) of a plurality of movable robots (e.g., $\mathbf{350}_n$, FIG. 4); and coordinating movements of the movable head and individual ones of the robots using an electronic controller (e.g., 310, FIG. 3) to coil the cable in spirally wound, vertically stacked, horizontal layers (e.g., 502-506, FIG. 5B).

In some embodiments of the above method, the method further comprises holding the spirally wound, vertically stacked, horizontal layers of the cable in a cable tank (e.g., 100, FIG. 4).

While this disclosure includes references to illustrative embodiments, this specification is not intended to be construed in a limiting sense. Various modifications of the described embodiments, as well as other embodiments within the scope of the disclosure, which are apparent to persons skilled in the art to which the disclosure pertains are deemed to lie within the principle and scope of the disclosure, e.g., as expressed in the following claims.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain the nature of this disclosure may be made by those skilled in the art without departing from the scope of the disclosure, e.g., as expressed in the following claims.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation."

Unless otherwise specified herein, the use of the ordinal adjectives "first," "second," "third," etc., to refer to an object of a plurality of like objects merely indicates that different instances of such like objects are being referred to, and is not intended to imply that the like objects so referred-to have to be in a corresponding order or sequence, either temporally, spatially, in ranking, or in any other manner.

Unless otherwise specified herein, in addition to its plain meaning, the conjunction "if" may also or alternatively be construed to mean "when" or "upon" or "in response to determining" or "in response to detecting," which construal may depend on the corresponding specific context. For example, the phrase "if it is determined" or "if [a stated condition] is detected" may be construed to mean "upon determining" or "in response to determining" or "upon detecting [the stated condition or event]" or "in response to detecting [the stated condition or event]."

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements. The same type of distinction applies to the use of terms "attached" and "directly attached," as applied to a description of a physical structure. For example, a relatively thin layer of adhesive or other suitable binder can be used to implement such "direct attachment" of the two corresponding components in such physical structure.

The described embodiments are to be considered in all respects as only illustrative and not restrictive. In particular, the scope of the disclosure is indicated by the appended claims rather than by the description and figures herein. All changes that come within the meaning and range of equivalency of the claims are to be embraced within their scope.

The description and drawings merely illustrate the principles of the disclosure. It will thus be appreciated that those of ordinary skill in the art will be able to devise various arrangements that, although not explicitly described or shown herein, embody the principles of the disclosure and are included within its spirit and scope. Furthermore, all examples recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions. Moreover, all statements herein reciting principles, aspects, and embodiments of the disclosure, as well as specific examples thereof, are intended to encompass equivalents thereof.

The functions of the various elements shown in the figures, including any functional blocks labeled as "processors" and/or "controllers," may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included. Similarly, any switches shown in the figures are conceptual only. Their function may be carried out through the operation of program logic, through dedicated logic, through the interaction of program control and dedicated logic, or even manually, the particular technique being selectable by the implementer as more specifically understood from the context.

As used in this application, the term "circuitry" may refer to one or more or all of the following: (a) hardware-only circuit implementations (such as implementations in only analog and/or digital circuitry); (b) combinations of hardware circuits and software, such as (as applicable): (i) a combination of analog and/or digital hardware circuit(s) with software/firmware and (ii) any portions of hardware processor(s) with software (including digital signal processor(s)), software, and memory(ies) that work together to cause an apparatus, such as a mobile phone or server, to perform various functions); and (c) hardware circuit(s) and or processor(s), such as a microprocessor(s) or a portion of a microprocessor(s), that requires software (e.g., firmware) for operation, but the software may not be present when it is not needed for operation." This definition of circuitry applies to all uses of this term in this application, including in any claims. As a further example, as used in this application, the term circuitry also covers an implementation of merely a hardware circuit or processor (or multiple processors) or portion of a hardware circuit or processor and its (or their) accompanying software and/or firmware. The term circuitry also covers, for example and if applicable to the particular claim element, a baseband integrated circuit or processor integrated circuit for a mobile device or a similar integrated circuit in server, a cellular network device, or other computing or network device.

"SUMMARY OF SOME SPECIFIC EMBODIMENTS" in this specification is intended to introduce some example embodiments, with additional embodiments being described in "DETAILED DESCRIPTION" and/or in reference to one or more drawings. "SUMMARY OF SOME SPECIFIC EMBODIMENTS" is not intended to identify essential elements or features of the claimed subject matter, nor is it intended to limit the scope of the claimed subject matter.

What is claimed is:

1. An apparatus, comprising:

a movable head to guide a hanging section of a cable;

a plurality of independently movable robots, each of the robots (i) having one or more rakes for moving downed sections of the cable and (ii) configured to move independent of the movable head and independent of each other robot; and an electronic controller to coordinate movements of the movable head and individual ones of the robots to coil the cable in spirally wound, vertically stacked, horizontal layers.

2. The apparatus of claim 1, further comprising:

first and second parallel stationary rails; and a third rail mounted on and translatable along the first and second parallel stationary rails; and wherein the movable head is mounted on and translatable along the third rail.

3. The apparatus of claim 1, wherein each individual one of the robots is operable to horizontally push or pull the downed sections of the cable using the one or more rakes thereof.

4. The apparatus of claim 1, further comprising a cable tank to hold the spirally wound, vertically stacked, horizontal layers of the cable.

5. The apparatus of claim 4, wherein the cable tank comprises a circular horizontal base and outer and inner walls attached to the base; and wherein the robots are positioned to move in the cable tank between the outer and inner walls.

6. The apparatus of claim 1, further comprising one or more sensors to monitor catenary shape of the hanging section.

7. The apparatus of claim 6, wherein at least one of the one or more sensors is mounted on the movable head.

8. The apparatus of claim 6, wherein the electronic controller is configured to adjust movements of the movable head in response to monitoring data received from the one or more sensors.

9. The apparatus of claim 1, wherein the movable head and robots are operable, in communication with the electronic controller, to coil at least 1000 km of the cable in the spirally wound, vertically stacked, horizontal layers.

10. The apparatus of claim 1, wherein the individual ones of the robots are configured to communicate with the electronic controller via respective wireless links.

11. The apparatus of claim 1, further comprising an engine to feed sections of the cable to the movable head.

12. The apparatus of claim 1, wherein the cable comprises one or more optical fibers.

13. The apparatus of claim 1, wherein the cable is a submarine communications cable.

14. The apparatus of claim 1, further comprising:

first and second parallel stationary rails;

a third rail mounted on and translatable along the first and second parallel stationary rails, wherein the movable head is mounted on and translatable along the third rail;

a cable tank to hold the spirally wound, vertically stacked, horizontal layers of the cable, wherein (i) the cable tank comprises a circular horizontal base and outer and inner walls attached to the base and (ii) the robots are positioned to move in the cable tank between the outer and inner walls;

one or more sensors to monitor catenary shape of the hanging section, wherein (i) at least one of the one or more sensors is mounted on the movable head and (ii) the electronic controller is configured to adjust movements of the movable head in response to monitoring data received from the one or more sensors; and an engine to feed sections of the cable to the movable head, wherein:

each individual one of the robots is operable to horizontally push or pull the downed sections of the cable using the one or more rakes thereof; and the individual ones of the robots are configured to communicate with the electronic controller via respective wireless links.

15. An automated cable-coiling method, comprising:

guiding a hanging section of a cable using a movable head;

moving downed sections of the cable using rakes of a plurality of independently movable robots, each of the robots configured to move independent of the movable head and independent of each other robot; and coordinating movements of the movable head and individual ones of the robots using an electronic controller to coil the cable in spirally wound, vertically stacked, horizontal layers.

16. The method of claim 15, further comprising holding the spirally wound, vertically stacked, horizontal layers of the cable in a cable tank.

17. The method of claim 15, further comprising:

translating a third rail along first and second parallel stationary rails; and translating the movable head along the third rail.

18. The method of claim 15, further comprising:

at least one of the robots horizontally pushing or pulling the downed sections of the cable using the one or more rakes thereof.

19. The method of claim 15, further comprising:

holding the spirally wound, vertically stacked, horizontal layers of the cable in a cable tank.

20. The method of claim 15, further comprising:

moving at least one of the robots in the cable tank between outer and inner walls of the cable tank further comprising a circular horizontal base attached to the outer and inner walls.

* * * * *